US007128612B2

(12) United States Patent
Chang et al.

(10) Patent No.: US 7,128,612 B2
(45) Date of Patent: Oct. 31, 2006

(54) ELECTRICAL CARD CONNECTOR

(75) Inventors: Wei-Cheng Chang, Tu-cheng (TW); Hsueh Lung Hsiao, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/322,693

(22) Filed: Dec. 30, 2005

(65) Prior Publication Data

US 2006/0223377 A1 Oct. 5, 2006

(30) Foreign Application Priority Data

Apr. 1, 2005 (TW) ..... 94205104 U

(51) Int. Cl.
*H01R 24/00* (2006.01)
*H01R 13/648* (2006.01)

(52) U.S. Cl. ..... 439/630

(58) Field of Classification Search ..... 439/630, 439/607

See application file for complete search history.

(56) References Cited

U.S. PATENT DOCUMENTS 5,161,989 A * 11/1992 Okubo et al. ..... 439/159
6,068,516 A * 5/2000 Chang ..... 439/633
6,386,920 B1 5/2002 Sun
6,478,630 B1 * 11/2002 Hsu ..... 439/680
6,666,724 B1 * 12/2003 Lwee ..... 439/630
6,716,066 B1 * 4/2004 Kuo ..... 439/630
6,761,572 B1 * 7/2004 Chou ..... 439/188
6,783,399 B1 * 8/2004 Joung ..... 439/630
6,926,560 B1 * 8/2005 Chu ..... 439/630
6,969,281 B1 * 11/2005 Lai ..... 439/630
7,004,770 B1 * 2/2006 Wu ..... 439/159
7,056,155 B1 * 6/2006 Fan ..... 439/630
7,059,910 B1 * 6/2006 Chang ..... 439/630
2004/0259422 A1 * 12/2004 Chang ..... 439/630

FOREIGN PATENT DOCUMENTS

TW 570336 1/2004

* cited by examiner

*Primary Examiner*—Ross Gushi
*Assistant Examiner*—Larisa Tsukerman
(74) *Attorney, Agent, or Firm*—Wei Te Chung

(57) ABSTRACT

An electrical card connector is provided for accommodating various electrical cards. The electrical card connector comprises an integral housing (1) defining an inserting port (11), a plurality of terminals (2, 3, 4, 5) respectively received in the housing, a metal shell (7) assembled on the housing. The housing has a top bridge (16) around the inserting port thereof. The terminals (5) extend out of the housing through the inserting port. The metal shell is formed with a supporting arm on a front edge thereof, the supporting arm is disposed below the top bridge and support the top bridge upwardly to prevent the inserting port from distorting during soldering the terminals (5) to the print circuit board.

6 Claims, 5 Drawing Sheets

ELECTRICAL CARD CONNECTOR

BACKGROUND OF THE INVENTION

1. Field of the Invention

The present invention is generally related to an electrical card connector for connecting an electrical card with an electrical equipment.

2. Description of Related Art

To adapt to the development of communication and digital techniques, electrical cards are widely used in varied electrical equipments for saving information. Some card connectors, which are used for electrically connecting the electrical cards with equipments, are able to receive several different kinds of electrical cards, so that corresponding electrical equipment may engaging with varied electrical cards.

Such an electrical card connector comprises an integral housing, a plurality of contacts for different kinds of electrical cards, and a metal shell covering the housing. The housing has a top plate, a bottom plate and opposite sidewalls linking the top plate and bottom plate. The housing defines a space for the electrical cards and an inserting port in a front face thereof surrounded by the top plate, the bottom plate and the sidewalls. The contacts are received in the housing, and a part of them extend through the inserting port and out of the front face of the housing for soldering to a print circuit board. Since the housing is just formed by plastic, the top plate around the inserting port easily caves in when the contacts near the front-face of the housing are soldered to the print circuit board, and that will lead to a distortion of the inserting port of the housing, and the electrical cards can not insert into the housing normally.

Hence, an electrical card connector is required to overcome the disadvantages of the related art.

SUMMARY OF THE INVENTION

Accordingly, an object of the present invention is to provide an electrical card connector, which is in a firm configuration and can prevents an inserting port from distorting.

To achieve the above objects, an electrical card connector in accordance with the present invention comprises a housing defining an inserting port for electrical cards and having a bottom plate and a top bridge; a plurality of terminals respectively received in the housing, each terminal having a contacting portion for corresponding electrical card and a tail portion for soldering; a supporting arm set below the top bridge to support the top bridge.

Other objects, advantages and novel features of the present invention will be drawn from the following detailed description of a preferred embodiment of the present invention with attached drawings:

DETAILED DESCRIPTION OF THE INVENTION

Reference will now be made in detail to the preferred embodiment of the present invention.

Figure 1:
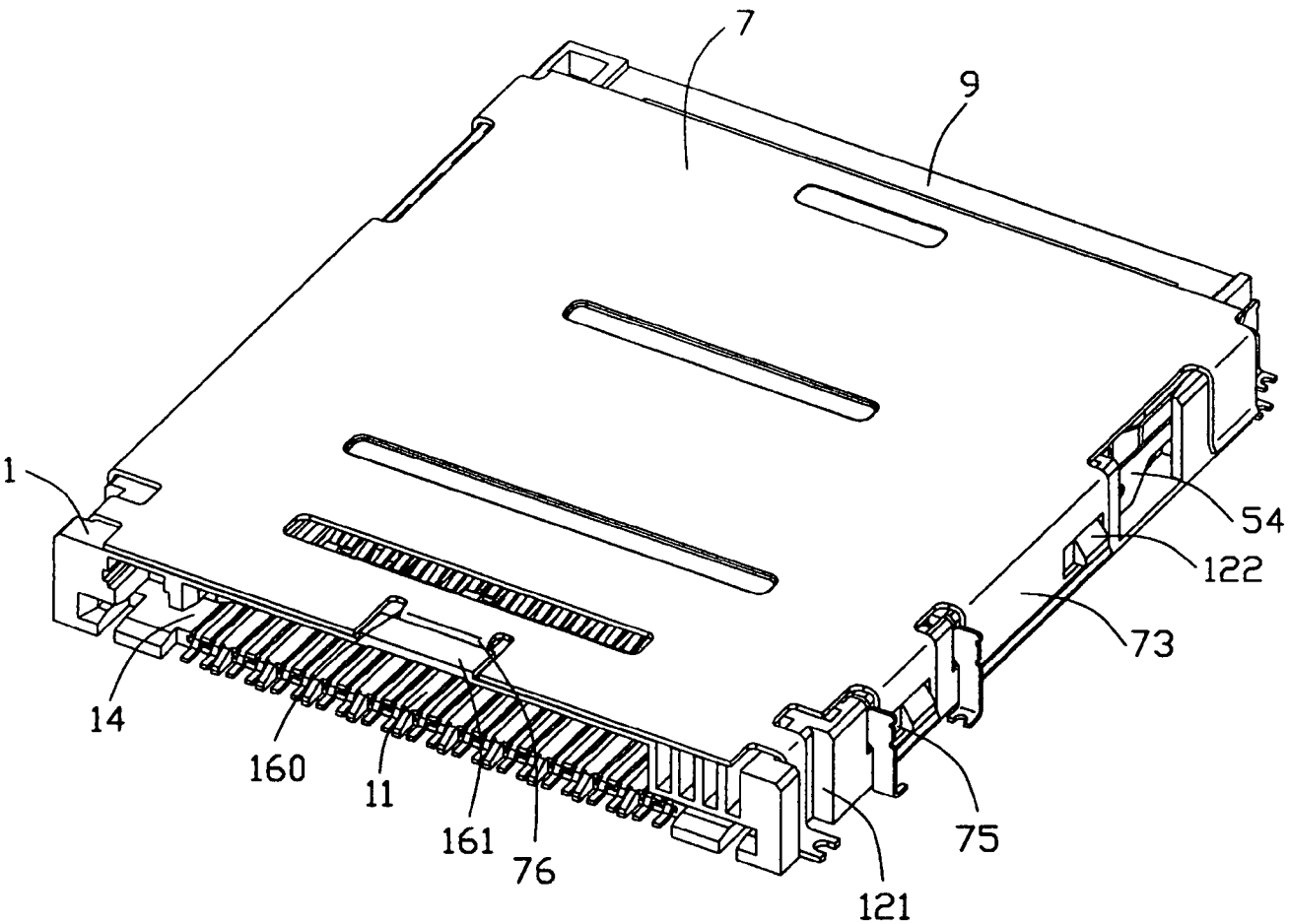
FIG. 1 is a perspective view of an electrical card connector in accordance with the present invention.
Figure 2:
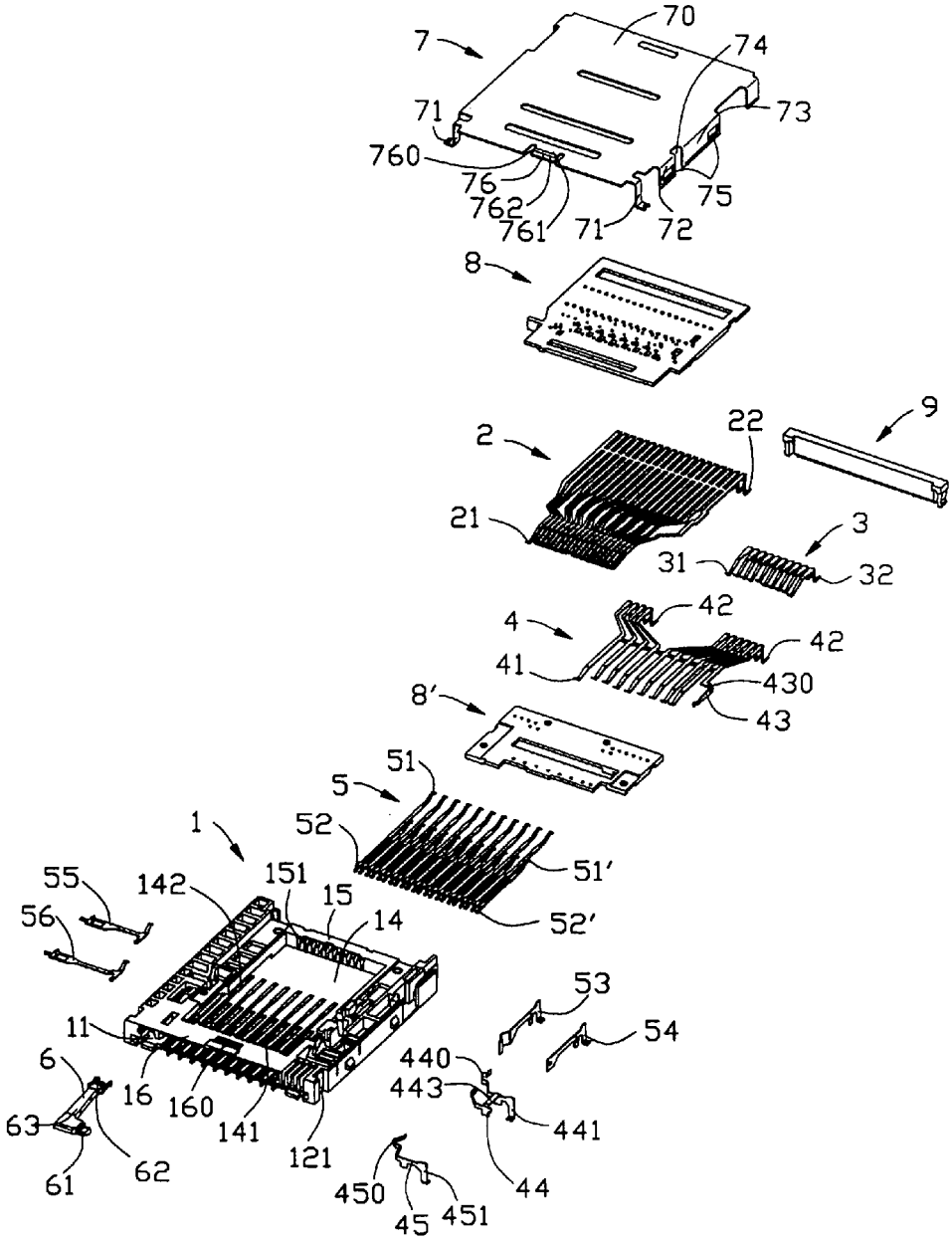
FIG. 2 is an exploded, perspective view of the electrical card connector shown in FIG. 1.

Referring to FIG. 1 and FIG. 2, an electrical card connector in accordance with the present invention can engage with several different kinds of electrical cards. The electrical card connector comprises a housing 1, a plurality of terminals, a anti-mismating mechanism 6, a metal shell 7, two insulative boards 8, 8', a terminal spacer 9 and switch devices. The terminals include the first terminals 2, the second terminals 3, the third terminals 4 and the fourth terminals 5.

Figure 3:
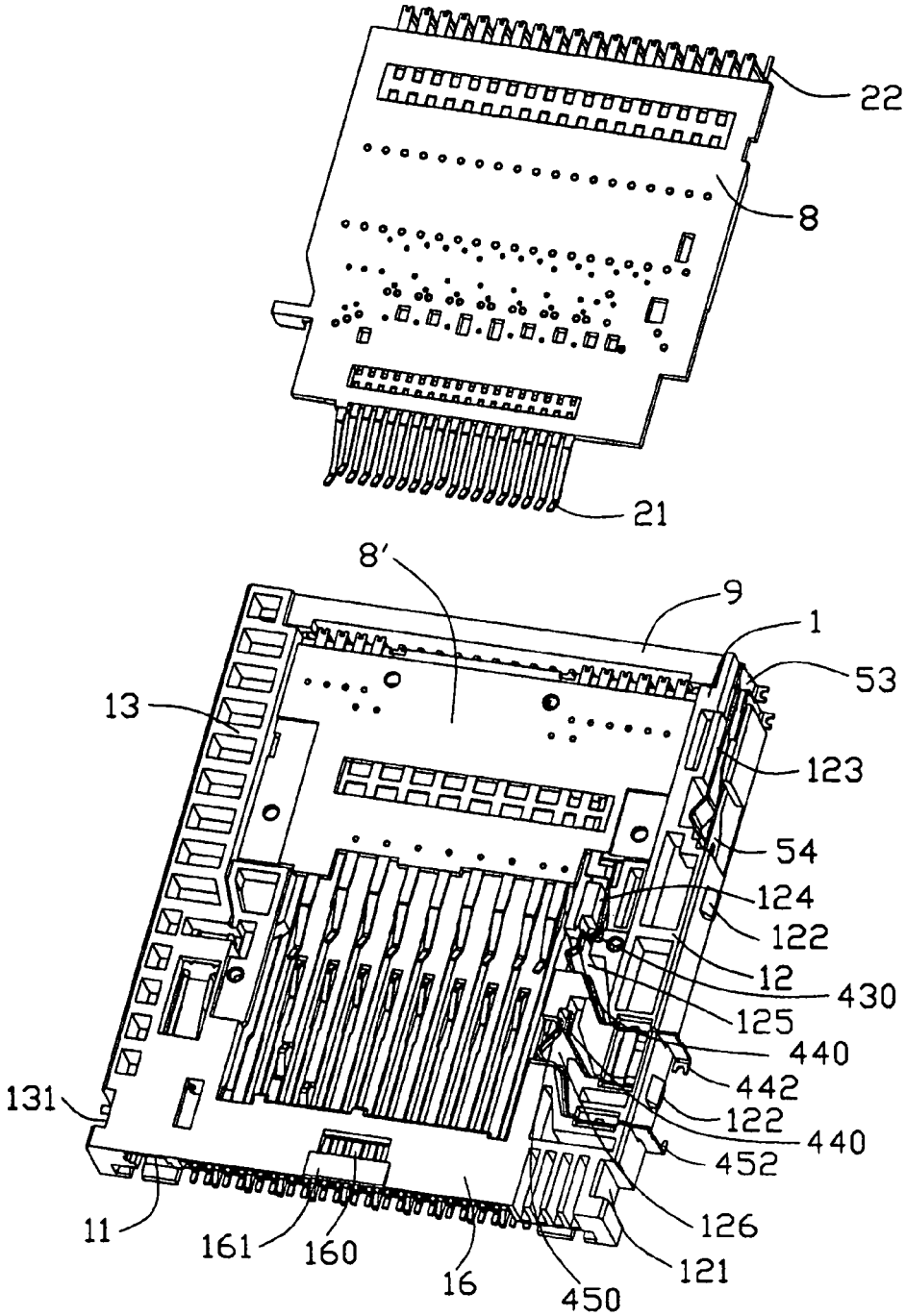
FIG. 3 is an a partially exploded, perspective view of the card electrical connector shown in FIG. 1.

Referring to FIGS. 1–3, the housing 1 is approximately box-liked and has opposite sidewalls 12, 13, a bottom plate 14, a rear wall 15 connecting the bottom plate 14 and opposite sidewalls 12, 13 and a top bridge 16 connecting a front portions of the opposite sidewalls 12, 13. The housing 1 defines an inserting port 11 recessed inwardly from a front surface and surrounded by the bottom plate 14, the top bridge 16 and the sidewalls 12, 13. The bottom plate 14 is formed with a plurality of channels 141, 142 extending forward till a front surface of the housing 1. The channels 141, 142 are in different lengths and arranged alternately for receiving the fourth terminals 5. The rear wall 15 is also formed with a plurality of channels 151 for retaining the second terminals 3. The top bridge 16 has a rectangular hole 160 and a projecting bar 161 in front of and adjacent to the rectangular hole 160 on the top surface thereof. The sidewalls 12, 13 separately provide a notch 121, 131 on exterior side face and through the sidewalls 12, 13 in a vertical direction. The sidewall 12 has a plurality of lathing blocks 122 for engaging with the metal shell 7, so does the sidewall 13. Moreover, the sidewall 12 has a plurality of socket 123, 124,125,126 for switch devices.

Each first terminal 2 has a contacting portion 21 for an XD (XD-picture) card and a tail portion 22 for soldering to a print circuit board (not shown). The first terminals 2 are set on the insulative board 8 to form a terminal module (not labeled) and then assemble to the housing 1 together. Each second terminal 3 has a contacting portion 31 for a MS (Memory Stick) card and a tail portion 32 for soldering. The second terminals 3 are retained in the channels 151 of the rear wall 15 of the housing 1.

The third terminals 4 comprise a plurality of terminals with contacting portions 41 for an SD (Super Density, Secure Digital)/MMC (Multi-Media Card) card and a switch terminal 43. The third terminals 4 are set on the insulative board 8' to form another terminal module (not labeled) and then assemble to the housing 1 together. Each third terminal 4 has a tail portion 42 for soldering to the print circuit board, and the tail portions 42 are divided into two groups to leave a space therebetween for laying the second terminals 3. The fourth terminals 5 comprise two rows of contacting portions 51, 51' for an SM card with different lengths and arranged alternately and tail portions 52, 52' for soldering. The fourth terminals 4 are retained in the channels 141,142 on the bottom plate 14 of the housing 1.

Figure 5:
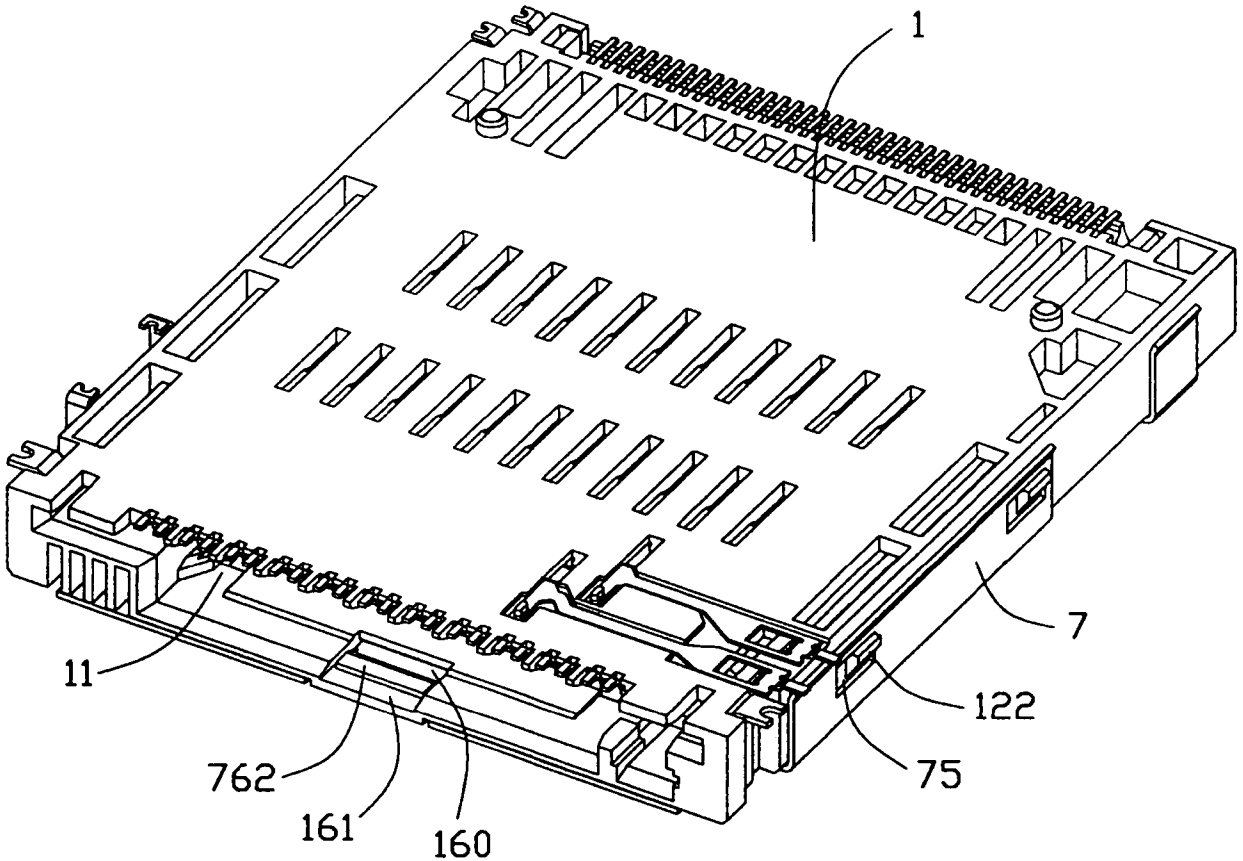
FIG. 5 is another perspective view of the electrical card connector in accordance with the present invention, taken from another angle.

All of the contacting portions 21, 31, 41, 51, 51' of the terminals 2, 3, 4, 5 are explored in an accommodate space defined by the housing 1 for receiving the cards to electrical conduct with corresponding cards, and the tail portions 22, 32, 42 of the terminals 2, 3, 4 are extending rearwards and out of the housing 1 through a rear face of the housing 1, and the tail portions 52, 52' of the terminals 5 are extending forwardly and out of the housing 1 through front face of the housing 1. Referring to FIG. 2 and FIGS. 5, the longitudinal terminal spacer 9 is assembled to a rear portion of the housing 1 to retain the tail portions 22, 32, 42 of the terminals 2, 3, 4 in a same surface.

Referring to FIGS. 2–3, the switch devices comprising first switch device having switch terminals 43, 44, second switch device having terminals 53, 54 and a protecting terminal 45. The switch terminal 44 has two spring finger 440, a holding portion 441 retained by the housing 1, a leg 442 for soldering to a print circuit board (not shown) and a connecting portion 443 linking the two spring fingers 440. The switch terminal 43 has a conductive end 430. The switch terminal 45 has a spring finger 450 and a holding portion 451. When the SD/MMC card insert into the housing 1, one of the spring fingers 440 of the switch terminal 44 will be pushed by side of the SD/MMC card laterally and touches the conductive end 430. The protecting terminal 45 may pushed laterally and touch another spring fingers 440 of the switch terminal 44, when the SD/MMC card inserts into the housing 1 completely.

Figure 4:
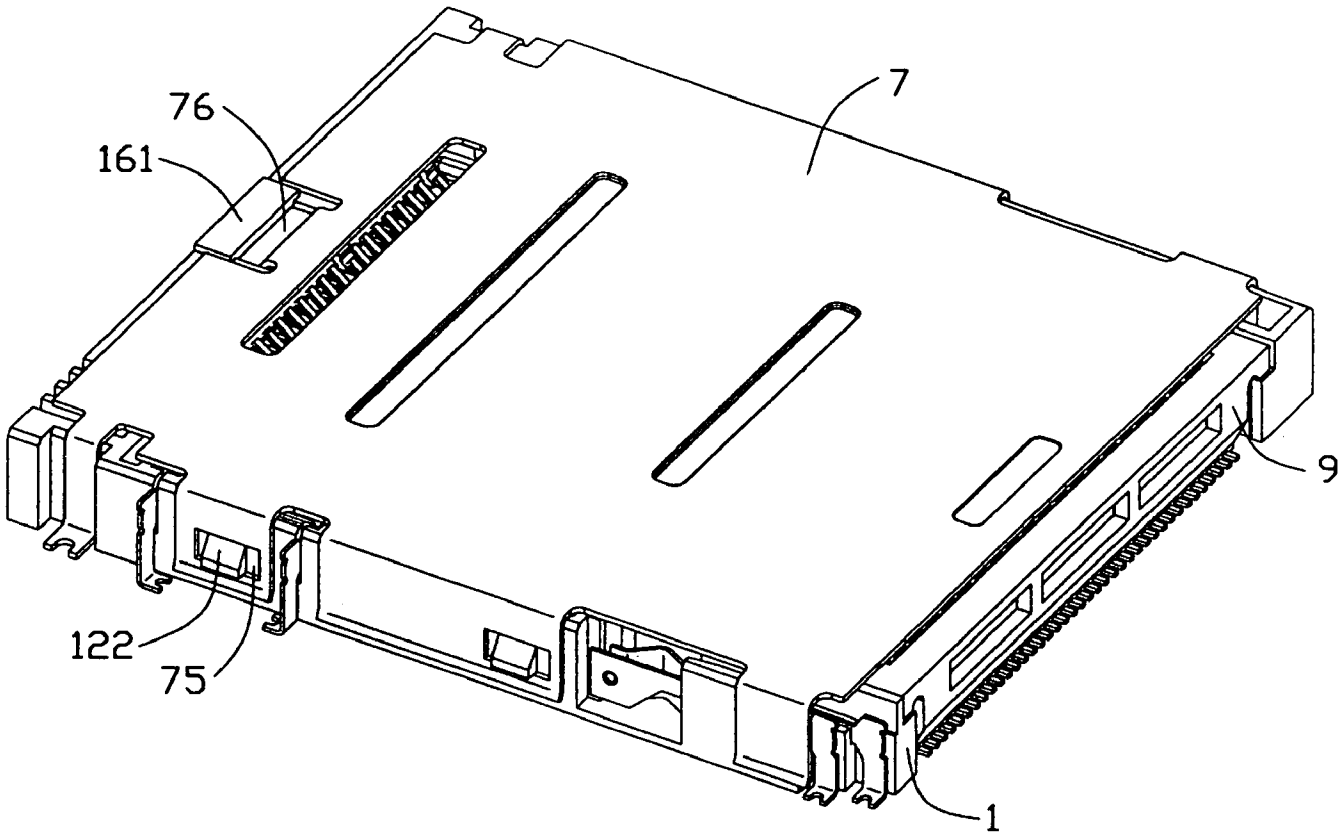
FIG. 4 is another perspective view of the electrical card connector in accordance with the present invention, wherein a metal shell is assembled to the housing but not positioned.

Referring to FIGS. 3–5, the defend mechanism 6 is approximately L-shaped and comprises a head portion 61, a tail 62 and an intermediate portion 60 connecting the head portion 61 and the tail 62. The tail 62 is locked in of the housing 1, the head portion 61 is exposed in the accommodate space adjacent to the card inserting port 11. The header portion 61 can be deflected when XD or MS card inserted into the housing 1 in a vertical direction to set in a cavity for the other and prevents the electrical card connector from receiving XD and MS card at same time.

Referring to FIGS. 1–2, the metal shell 7 comprise a top wall 70, a pair of grounding tabs 71 and a plurality of discontiguous slices 72, 73 bended from opposite sides of the top wall 70. The grounding tabs 71 are formed on opposite sides a top wall 70 respectively corresponding to the notches 121, 131 of the housing 1, each slice 72, 73 defines a lathing hole 75. The top wall 70 defines many long and narrow slots (not labeled) and a gap 760 on a front edge thereof. The top wall 70 is formed with a supporting arm 76 extending from a front edge of the gap 760. The supporting arm 76 has an inclined portion 761 bended from the metal shell 7 downwardly and a horizontal portion 762 extending forwardly from the inclined portion 761.

Referring to FIG. 1 and FIGS. 4–5, first assemble the metal shell 7 to the housing 1, the lathing blocks 122 of the housing 1 are received in corresponding lathing holes 75 of the metal shell 7, and the grounding tabs 71 are received in the notches 121, 131, the supporting arm 76 of the metal shell 7 is set in the rectangular hole 160 of top bridge 16 of the housing 1, the projecting bar 161 engages with the gap 760 of the metal shell 7. Finally, push the metal shell 7 forwardly toward the inserting port 11 to set the horizontal portion 762 below and against a bottom surface of a front portion of the top bridge 16, so that the supporting arm 76 can support the front end of the top bridge 16 adjacent to the inserting port 11 and prevent the inserting port 11 from distorting during soldering the tail portions 52, 52' of the fourth terminal 5 to the print circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical card connector for various electrical cards comprising:

a housing defining an inserting port for the electrical cards and having a bottom plate and a top bridge around the inserting port;

a plurality of terminals respectively received in the housing, each terminal having a contacting portion for contacting with corresponding electrical card and a tail portion for soldering;

a supporting arm disposed below the top bridge to support the top bridge;

a metal shell assembled on the housing, the supporting arm is disposed on a top wall of the metal shell;

the housing defines an accommodate space for the electrical cards, the contacting portions of terminals are exposed in the accommodate space, a part of the terminals lay on the bottom plate and corresponding tail portions extend out of the housing through the inserting port; and a anti-mismating mechanism, the anti-mismating mechanism comprises a head portion, a tail and an intermediate portion connecting the head portion and the tail, the tail portion is locked in the housing wherein the head portion is exposed in the accommodate space adjacent to the card inserting port.

2. The electrical card connector as claimed in claim 1, wherein the metal shell defines a gap on a front edge thereof, the supporting arm extends from a front edge of the gap.

3. The electrical card connector as claimed in claim 1, wherein the housing has the bottom plate, opposite sidewalls and the top bridge connecting a front portions of the opposite sidewalls, the inserting port is surrounded by the bottom plate, the sidewalls and the top bridge, the top bridge is formed with a through hole on a top surface thereof, the supporting arm is set underside of the top bridge through the hole to support the top bridge.

4. The electrical card connector as claimed in claim 1, further comprising a terminal spacer for retaining the tail portions of the terminals.

5. An electrical card connector for various electrical cards comprising:

a housing defining an inserting port and an accommodate space for the electrical cards;

a plurality of terminals respectively received in the housing, each terminal having a contacting portion for corresponding electrical card and a tail portion for soldering;

a metal shell assembled on the housing and formed with a supporting arm on a top wall thereof, the supporting arm inserted into the inserting port and supporting the inserting port upwardly;

wherein the metal shell defines a gap on a front edge thereof, the supporting arm extends from a front edge of the gap; and a anti-mismating mechanism, the anti-mismating mechanism comprises a head portion, a tail and an intermediate portion connecting the head portion and the tail, the tail portion is locked in the housing wherein the head portion is exposed in the accommodate space adjacent to the card inserting port.

6. An electrical card connector for various electrical cards comprising:

a housing defining an inserting port for the electrical cards and having a bottom plate and a top bridge around the inserting port;

a plurality of terminals respectively received in the housing, each terminal having a contacting portion for contacting with corresponding electrical card and a tail portion for soldering;

a metallic shell vertically covering the inserting port and the top bridge, and essentially opposite to the bottom plate, wherein the shell includes an offset tab and the top bridge defines an offset bump, the offset tab and the offset bump being in alignment with each other in a vertical direction while with a reverse arrangement compared with remaining portions of the offset tab and the offset bump in the vertical direction;

wherein the housing has the bottom plate, opposite sidewalls and the top bridge connecting a front portions of the opposite sidewalls, the inserting port is surrounded by the bottom plate, the sidewalls and the top bridge, the top bridge is formed with a through hole on a top surface thereof, a supporting arm is set underside of the top bridge through the hole to support the top bridge; and a anti-mismating mechanism, the anti-mismating mechanism comprises a head portion, a tail and an intermediate portion connecting the head portion and the tail, the tail portion is locked in the housing wherein the head portion is exposed in the accommodate space adjacent to the card inserting port.

* * * * *